US005310072A

United States Patent [19]

Matusovsky et al.

[11] Patent Number: 5,310,072

[45] Date of Patent: May 10, 1994

[54] BEVERAGE AND SNACK HOLDER

[76] Inventors: Luba Matusovsky; Edward Lopoyan, both of 1530 N. Poinsettia Pl., Apt. 312, Los Angeles, Calif. 90046

[21] Appl. No.: 101,541

[22] Filed: Aug. 2, 1993

[51] Int. Cl.[5] ..... B65D 3/00

[52] U.S. Cl. ..... 220/23.83; 220/737

[58] Field of Search ..... 220/575, 23.83, 23.86, 220/737, 739

[56] References Cited

U.S. PATENT DOCUMENTS

| | | | |
|---|---|---|---|
| 163,919 | 6/1875 | Cushman | 215/6 |
| 3,197,057 | 7/1965 | Weitzner | 215/100 |
| 3,413,128 | 11/1968 | Steinbarth et al. | 99/171 |
| 3,526,313 | 9/1970 | Kull et al. | 206/4 |
| 4,491,220 | 1/1985 | Daviss | 206/217 |
| 4,635,291 | 1/1987 | Barton | 383/24 |
| 4,732,274 | 3/1988 | Bouton | 220/23.83 X |
| 4,795,028 | 1/1988 | Wittig et al. | 206/217 |
| 4,823,958 | 4/1989 | Mahmud | 220/23.83 X |
| 4,883,935 | 11/1989 | Fairchild et al. | 220/23.83 X |
| 4,936,481 | 6/1990 | Rosenfeld | 220/23.86 |
| 5,085,330 | 2/1992 | Paulin | 215/6 |
| 5,180,079 | 1/1993 | Jeng | 220/23.83 X |

*Primary Examiner*—Steven M. Pollard

*Attorney, Agent, or Firm*—Arthur Freilich; Robert D. Hornbaker; Leon D. Rosen

[57] ABSTRACT

A snack food container (12, FIG. 2) is described, which can be coupled to an ordinary beverage container (14) such as a standard soda can, to enable both containers to be held with one hand when drinking the beverage, without spilling the solid snack food pieces. The snack container has a vertically-extending passage (22) which opens in an upward direction and which closely receives the beverage container, preferably in a resilient interference fit. The snack container has a chamber (24) that holds pieces of snack food, and has a door (32) that can be opened to remove snack food when the combination of containers is vertical and which can be closed to prevent spillage when the combination is raised and tipped for drinking the beverage.

11 Claims, 3 Drawing Sheets

FIG. 1
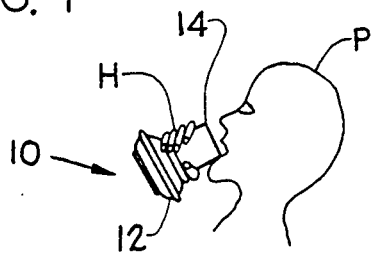
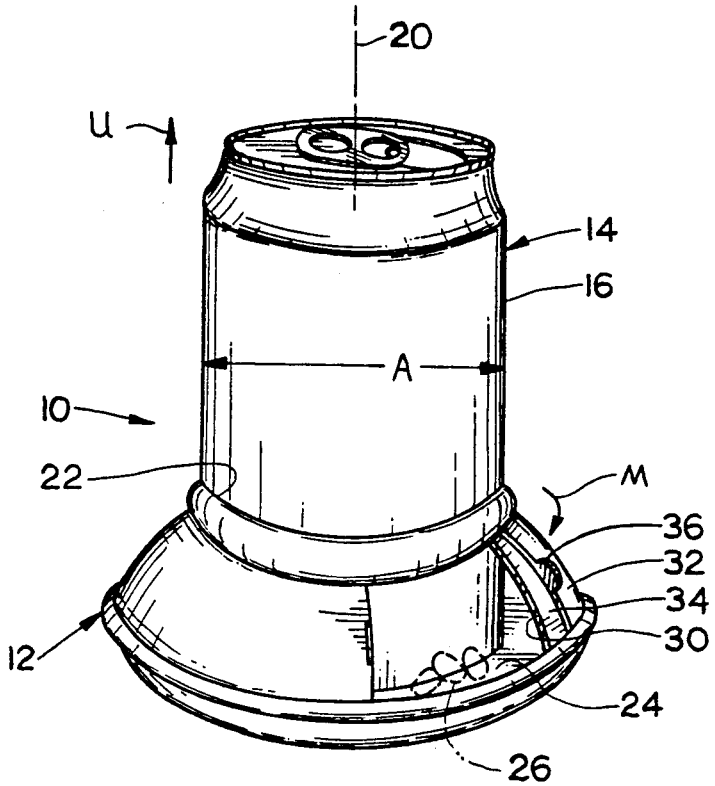
FIG. 2
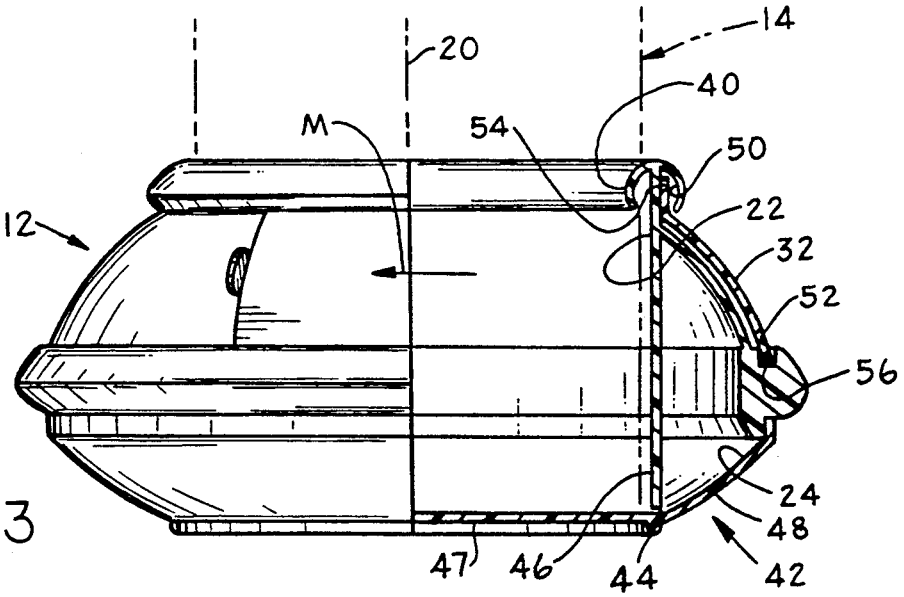
FIG. 3

BEVERAGE AND SNACK HOLDER

BACKGROUND OF THE INVENTION

There are occasions, such as in a motion picture theater or at a sporting event, when a person wishes to drink a beverage such as soda and eat pieces of solid snack food such as nuts or popcorn, when there is no table surface on which containers can rest. Although one hand can hold an open soda can and the other can hold a snack container, it is difficult in this situation to open the snack container, and it is awkward for the person to hold the opened snack container and withdraw a snack piece and place it in his/her mouth. The problem is compounded when the person wishes to hold another item such as a purse or program. Apparatus that enabled the holding of a beverage container and solid snack food container as a unit in one hand, even when lifting and tilting the beverage container to drink from it, without spilling the snack pieces, would greatly increase convenience.

SUMMARY OF THE INVENTION

In accordance with one embodiment of the present invention, a snack food container is provided which can be readily coupled to an ordinary beverage container, to enable both the beverage and snack food pieces to be conveniently consumed in an environment where there is no table surface to stably support containers. The snack food container has a vertical passage which opens in an upward position, and which closely receives the beverage container, preferably in resilient interference fit therewith. The snack container has a closed snack-holding chamber and has a door that can be opened to remove a snack piece and then be closed. With the door closed, the snack container and beverage container can be raised and tilted as a unit to enable a person to drink the beverage without spilling the snack food pieces.

The snack food container can have a bottom wall which limits downward movement of the beverage container, and can have an annular bottom wall portion that surrounds the bottom of the container, to provide a wide base for stable holding of the combination on the lap of the person. The snack food container can have circular tracks that slidably support a curved door with circular top and bottom track followers. The door slides in a circular path to open and close the snack food container, so the door is stably held in both its opened and closed positions.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of the combination of a snack food container of the present invention and an ordinary "standard" soda can, showing the manner in which the combination can be used in drinking from the beverage container.

FIG. 2 is an isometric view of the combination of FIG. 1, with the door primarily open.

FIG. 3 is a side view of the snack container of FIG. 2, with the right half of the figure being a sectional view and the left half being an elevation view.

DESCRIPTION OF THE PREFERRED EMBODIMENTS

Figure 4:
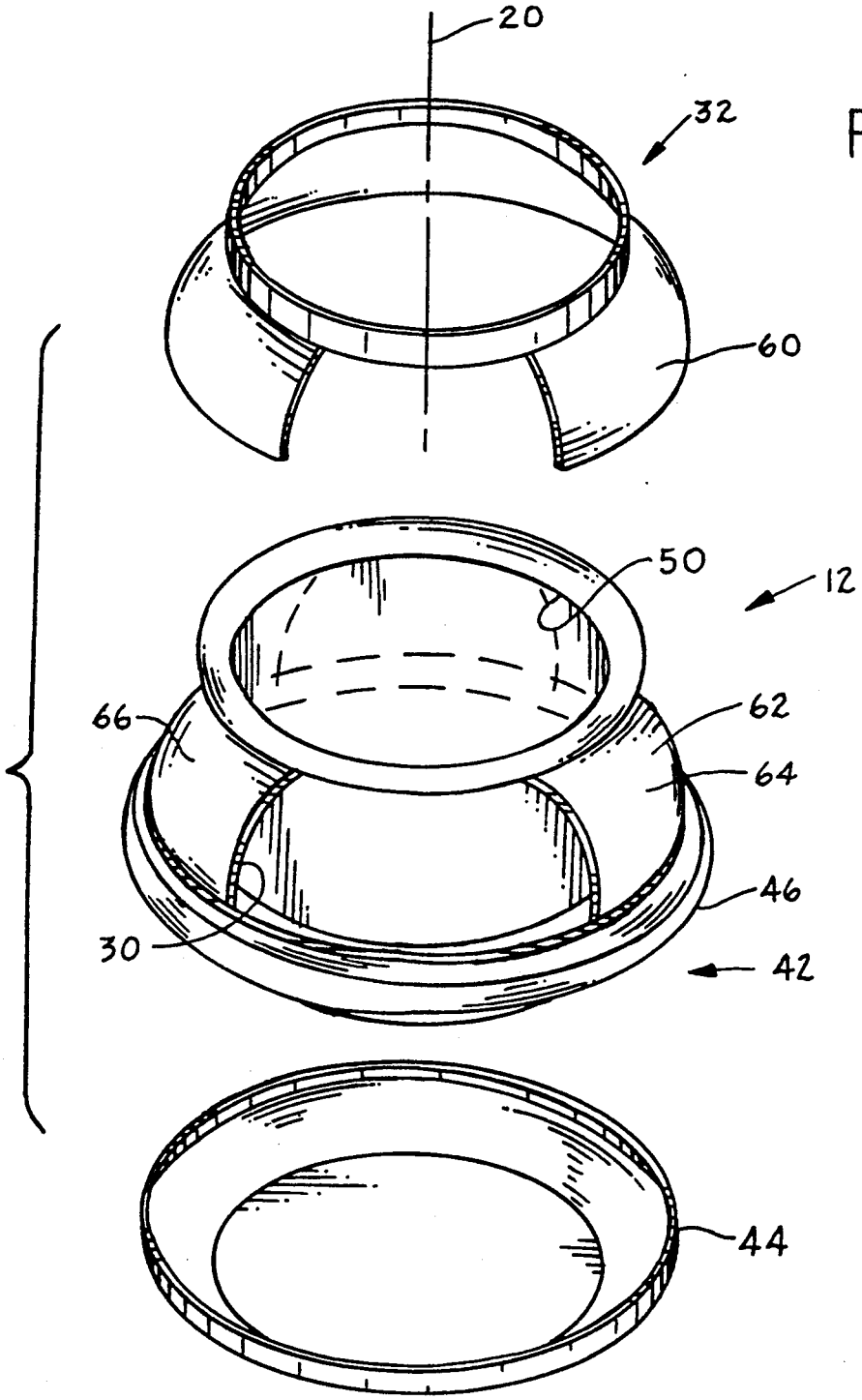
FIG. 4 is an exploded isometric view of the snack food container of FIG. 3.

FIG. 1 illustrates the combination 10 of a snack food container 12 and a "standard" soda can beverage container 14, showing the manner in which the combination can be held in the hand H of a person P, to enable the person to lift and tilt the combination so as to drink from the beverage container. As shown in FIG. 2, the beverage container 14 is of a very common size of soda can container which has a vertical cylindrical portion 16 having a diameter A of about 5.6 cm. The snack container 12 is of annular shape, with a vertical axis 20 and with a vertically-extending passage 22 which opens in an upward direction U. The snack container forms a food-holding chamber 24 which holds pieces of solid food indicated at 26. The pieces 26 of solid food may be generally referred to as "snack" food that is most commonly eaten in an informal setting, with a beverage that is drunk from its original initially-sealed container rather than a glass or cup which has a permanently opened top. The chamber walls are closed, except for an opening 30 that can be opened and closed by a door 32. FIG. 2 shows the door in an almost opened position, to display a small portion 34 of the outer side of the chamber walls which are opened and closed by the door. With the door opened, a person can project his fingers through the opening 30 to withdraw one or more pieces 26 of the snack food and place them in his mouth to eat. When the person becomes thirsty, he closes the door 32 by grasping a tab 36 and sliding the door along a curved path indicated by arrow M. With the door closed, the snack food pieces will not fall out of the opening when the combination is tipped. This enables the person to lift both the beverage container and snack food container and tip them to drink from the beverage container.

As shown in FIG. 3, the snack food container 12 includes a gripping portion 40 which can be readily deflected radially outwardly, away from the axis 20, when the soda can beverage container 14 is pressed downwardly into the passage 22. The gripping is preferably secure enough that the snack container will not fall off the beverage container if only the beverage container is supported. While the filled "standard" soda can (12 cm height) has a weight of about 13 ounces, the snack container has a weight that is preferably less than half as much, such as no more than 6 ounces. Thus, the gripping has to support only a small weight. A layer of high friction material such as rubber can be placed at 40.

Most of the snack container is stationary, and only the door 32 can move. Applicant forms the stationary part 42 in two pieces 44, 46 for ease of construction. The stationary part forms two circular tracks 50, 52 which capture the door 32 and which guide it in movement along the circular path M which is centered on the axis 20. The door 32 has upper and lower track followers 54, 56 which also extend in portions of a circle and which are held by the tracks. Applicant prefers that the snack container 12 be substantially symmetrical about the axis by 20 of the beverage container and passage, which facilitates holding the combination on the lap of a person in a dark movie theater, where the symmetry avoids the need for the person to determine the rotational position of the snack container. The snack container has an inner bottom wall portion 47 that supports the bottom of the beverage container, and has an outer bottom wall portion 48 that lies around the inner portion to provide a wide base for more stable support on the lap of a person.

FIG. 4 illustrates the construction of the snack container 12, showing the two parts 44, 46 of the stationary portion 42 of the container, and also showing the movable door 32. It can be seen that the door 32 has a chamber blocking portion 60 that extends more than 180° around the axis 20 of the snack container, and that the opening 30 extends by less than 180°, preferably about 60° to 90°. The use of a door that extends by over 180°, allows the door to lie outside of the static outer chamber wall 62 while being securely held in sliding movement on the stationary part of the container. The outer chamber wall has portion 64, 66 at opposite sides of the axis 20 to stably support the upper track. Of course, it is possible to block much of the space within the container, so only the region near the opening 30 holds snack pieces.

Figure 5:
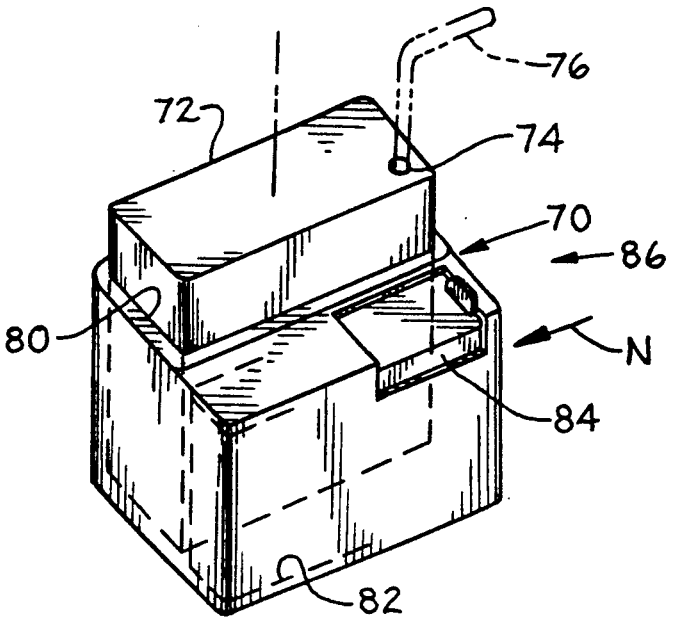
FIG. 5 is an isometric view of a snack food container constructed in accordance with another embodiment of the invention, with an ordinary fruit beverage box container installed therein.

FIG. 5 illustrates another snack container 70 which is designed to hold a "standard" fruit juice box 72. Such boxes, which have become very popular, commonly have an opening 74 at the top into which a straw 76 is inserted, the straw having a rigid pointed lower end to insert it through an initially closed opening at 74. The snack container 70 has a vertically opening passage 80 which is designed to closely receive a box 72 of predetermined dimensions, preferably to prevent the box from sliding vertically with respect to the snack container 70. The snack container forms a chamber 82 which holds snack food pieces that can be withdrawn by sliding a door 84 in the direction N to open the chamber and allow a piece to be withdrawn and eaten. A person preferably closes the door prior to lifting the combination 86 of snack and beverage containers to near his mouth so he can drink from the straw 76. Such door closing is preferred because it is common to tip the combination when preparing to the drink from the beverage container, especially when the person is trying the manipulate the combination so the outer end of the straw reaches his mouth.

Figure 6:
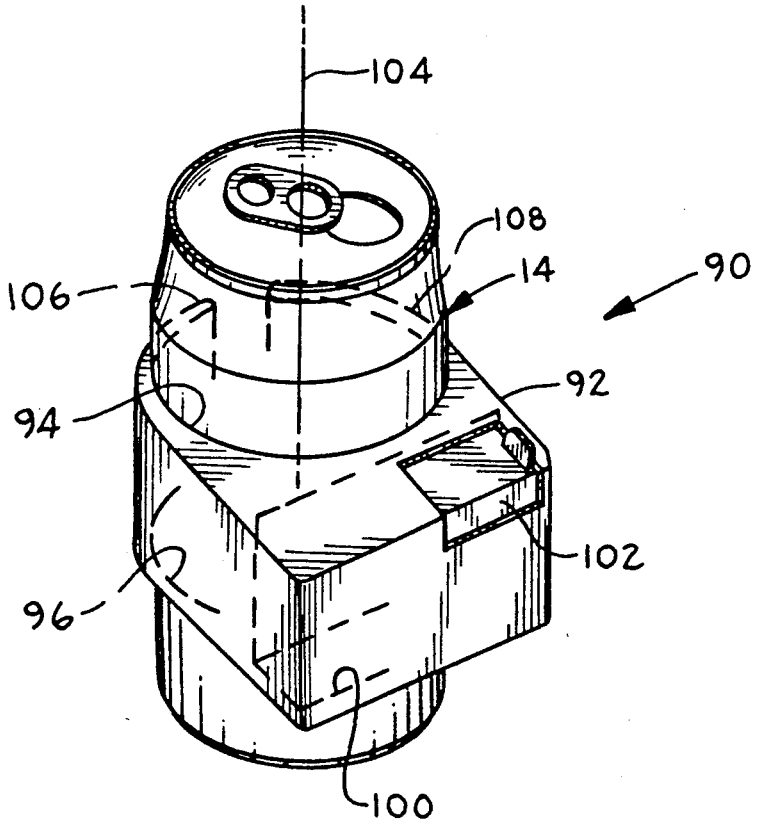
FIG. 6 is an isometric view of a snack food container constructed in accordance with another embodiment of the invention, with a soda can installed therein.

FIG. 6 illustrates another combination 90 of a standard soda can 14 and a snack container 92 designed to mount to the beverage container. The snack container 92 has a passage 94 with an open lower end 96 through which the beverage container 14 can project. This arrangement is especially useful where only a small amount of snack food is to be provided in the snack food container, such as less than one fourth the volume of liquid in the beverage container. The snack food container is light weight, and is therefore unlikely to slide down the beverage container because of the small weight of the snack food container and its contents. The snack food container has a chamber 100 for holding snack food pieces or articles, which is accessed by sliding a door 102 that lies on one side of the axis 104 of the snack food container passage. It may be noted that sufficient gripping of the snack food container to the beverage container is obtained by forming gripping arms 106, 108 that are flexed together to grip the standard beverage container 14 between them.

It may be noted that the snack food containers described above are custom made for holding a "standard" beverage container which has known horizontal dimensions. Thus, no alteration is required in the standard beverage container, which is not designed to mount to a snack container. Where resilient gripping of the beverage container is desired, the gripping part preferably has a diameter or width which is at least one half millimeter less than the corresponding dimension of the beverage container, so the width of the gripping portion of the snack container is expanded substantially to tightly grip the beverage container. The most common type of modern beverage container is a can with a cylindrical outside, which is commonly used for soda and beer. Fruit juice boxes are also becoming widely available. The snack food container can be adapted for mounting on more traditional beverage containers such as wine bottles of a predetermined outside diameter.

Thus, the invention provides a snack food container for holding solid articles of snack food, which enables the holding and drinking of liquid from a beverage container, especially a standard beverage container without any special mounting devices thereon, which greatly increases the convenience of handling both containers. The beverage container includes a vertical passage open at the top, which receives the beverage container, preferably in a resilient interference fit which enables the beverage container to be pressed into the passage with a moderate force that is preferably less than twenty pounds. The snack container has a chamber for holding snack food articles, with the chamber being closed except for a door that can be opened and closed. The door is opened to remove a snack article and is closed prior to drinking the beverage. Since the beverage container is commonly raised and tilted to drink the beverage, the closed door prevents spillage of the snack articles. A person requires only one hand to hold both containers even when drinking the beverage. A second hand is usually used to open the door and retrieve a snack for eating, and to then close the door. However, the second hand is used only occasionally, which greatly increases the convenience of holding and eating both a beverage and pieces of solid snack food.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. Apparatus that enables the drinking of a beverage from a beverage container of predetermined size, and the holding of a solid snack, using one hand, comprising:

a snack food container having a vertical axis and having a vertically extending passage which opens in an upward direction and which is of a size to closely receive said beverage container so said food and beverage containers can be handled as a unit, said snack container having walls forming a closed food-holding chamber for holding the solid snack, with said snack container walls including a door that can be opened and then closed, to enable a person to open the door to remove the solid snack and then close the door to prevent spillage of the solid snack when tipping the unit formed by said containers to drink the beverage.

2. The apparatus described in claim 1 wherein:

said food container has an inner bottom wall portion at the bottom of said passage to support said beverage container, and said food container has an outer bottom wall portion around said inner bottom wall portion, to thereby provide a wide base.

3. The apparatus described in claims 1 wherein:

said food container has passage walls forming said passage, said passage walls including a gripping portion which is resiliently expandable by at least 0.5 mm from a diameter slightly less than, to the diameter of, the outside of said beverage container of predetermined size.

4. The apparatus described in claim 1 wherein:

said food container has a door-guiding track lying on an imaginary circle that is substantially centered on said vertical axis, and said food container includes a curved slidable door with track a follower lying on said imaginary circle.

5. The food apparatus described in claim 4 wherein:

said track includes upper and lower tracks at the top and bottom of said door, said container has a pair of stationary wall portions at substantially opposite sides of said axis connecting said upper and lower tracks with a gap between said wall portions forming an opening to said chamber, said door track follower includes two followers including a first that extends 360° about said axis, and said door lies radially outside said stationary wall portions and has a blocking portion extending more than 180° about said axis.

6. The apparatus described in claim 1 including:

a beverage container of a standard soda can size having a cylindrical outside of 5.6 cm diameter, said passage having passage walls and said container lying in said passage in interference fit with said passage walls.

7. A dual container combination comprising:

a beverage container having a vertical axis and having predetermined outside horizontal dimensions perpendicular to said axis, said container containing a liquid, said container having a readily openable top through which said liquid can be drunk;

a snack container which has passage walls forming a vertical passage, said beverage container lying in said passage with said snack container having a passage axis substantially coincident with said beverage container axis, and said passage walls having gripping parts spaced apart by slightly less than at least one of said beverage container horizontal dimensions to grip and hold said beverage container against vertical sliding along said passage;

said snack container forming a chamber which holds solid food and said container having an opening for access to said solid food and a door which can close said opening.

8. The combination described in claim 7 wherein:

said beverage container has a cylindrical portion which lies in said passage, said snack container has circular tracks, and said door has circular track followers engaged with said tracks to slide in a circle thereon.

9. The combination described in claim 7 wherein:

said snack container has a bottom wall which lies under said beverage container and limits the depth of downward insertion of said beverage container in said passage.

10. The combination described in claim 7 wherein:

said passage extends vertically completely through said snack container, and said beverage container extends completely through said passage.

11. A method for holding both a beverage container containing a beverage and a snack container containing solid food, and enabling convenient drinking of the beverage without spilling the solid food, comprising:

constructing a snack container with a vertical passage which closely receives the beverage container, and with an openable and closeable snack chamber and filling said chamber with a plurality of pieces of snack food, and inserting said beverage container into said passage;

opening said snack chamber and withdrawing at least one of said pieces therefrom, and closing said snack chamber so the pieces therein will not fall out when the snack container is tipped;

lifting and tilting the combination of said snack container and said beverage container lying in said passage, and drinking said beverage from said beverage container.

* * * * *